US007236721B2

(12) United States Patent
Konishi

(10) Patent No.: US 7,236,721 B2
(45) Date of Patent: Jun. 26, 2007

(54) IMAGE FORMING DEVICE

(75) Inventor: Takashi Konishi, Nagaokakyo (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 166 days.

(21) Appl. No.: 11/097,739

(22) Filed: Mar. 31, 2005

(65) Prior Publication Data

US 2005/0220484 A1 Oct. 6, 2005

(30) Foreign Application Priority Data

Mar. 31, 2004 (JP) ..... 2004-105230

(51) Int. Cl.
*G03G 21/18* (2006.01)

(52) U.S. Cl. ..... 399/111; 399/110; 399/116

(58) Field of Classification Search ..... 399/107, 399/110, 111, 115, 116, 117, 118, 119, 120, 399/121, 122, 123, 125; 347/49, 138, 152
See application file for complete search history.

(56) References Cited

U.S. PATENT DOCUMENTS

| | | | | |
|---|---|---|---|---|
| 6,249,661 | B1 * | 6/2001 | Saitoh et al. | 399/117 |
| 6,947,687 | B2 * | 9/2005 | Yamaguchi et al. | 399/111 |
| 2001/0022903 | A1 * | 9/2001 | Shirasawa et al. | 399/116 |
| 2003/0016975 | A1 * | 1/2003 | Kojima | 399/384 |
| 2003/0235428 | A1 * | 12/2003 | Suzuki et al. | 399/107 |
| 2004/0005168 | A1 * | 1/2004 | Baek | 399/116 |
| 2004/0009008 | A1 * | 1/2004 | Park et al. | 399/116 |
| 2005/0047821 | A1 * | 3/2005 | Murayama et al. | 399/111 |
| 2005/0220481 | A1 * | 10/2005 | Yamaguchi et al. | 399/111 |

FOREIGN PATENT DOCUMENTS

| | | | |
|---|---|---|---|
| JP | 2002-179282 A | * | 6/2002 |
| JP | 11-184353 | | 7/2002 |
| JP | 2002-221889 | | 8/2002 |

* cited by examiner

*Primary Examiner*—Sophia S. Chen
(74) *Attorney, Agent, or Firm*—Hogan & Hartson LLP

(57) ABSTRACT

An image forming device includes a device main body, a process unit which is inserted into and removed from the device main body, and a lock mechanism which fixes a position of the process unit inserted in the device main body. The lock mechanism includes a slide member, an urging member and a receiving part. The slide member is provided on the process unit and is movable in a perpendicular direction with respect to an inserting and removing direction of the process unit. The urging member is provided between the process unit and the slide member and urges the slide member outward in the perpendicular direction. The receiving part is provided at a position in the device main body displaced from a passage where the process unit passes when being inserted and removed. The receiving part makes contact with the slide member urged outward in an inserting direction.

21 Claims, 4 Drawing Sheets

IMAGE FORMING DEVICE

BACKGROUND OF THE INVENTION

1. Field of the Invention

The present invention relates to an image forming device in which a process unit having devices related to an electrophotographic process can be inserted into or removed from a device main body. More specifically, the present invention relates to an image forming device having a lock mechanism for fixing a position of a process unit inserted in a device main body.

2. Description of Related Art

In an image forming device which forms a toner image on paper by an electrophotographic process, devices related to the electrophotographic process are unitized as a single unit or a plurality of collective units. The process unit is provided capable of being inserted into and removed from the device main body. As such a process unit, for example, there are a drum unit having a photoconductive drum, a toner unit accommodating toner and a fixing unit having a fixing device. By providing the process unit capable of being inserted into or removed from the device main body, each process device can be replaced easily. Therefore, even when a user is not a service person, the user can carry out a replacement operation of the process device. As a result, maintenance of the image forming device is improved.

In the above-described image forming device, the image quality is required to be maintained in a highly accurate manner. Therefore, when the process unit is inserted into the device main body, a position of the process unit is required to be fixed accurately in the device main body. A description will now be made of a conventional technique relating to the fixing of a position of the process unit. According to the conventional technique, the process unit is provided capable of being inserted into and removed from a device main body. When a cover of the device main body is closed, a gripper of the process unit makes contact with the cover and the position of the process unit is fixed. In particular, according to this conventional technique, since the gripper is formed with an elastic body, when fixing the position of the process unit with respect to the device main body, a high degree of accuracy is not required for a clearance between the process unit, which is to be replaced, and the device main body.

According to the above-described conventional technique, when the cover of the device main body is closed, the position of the process unit is fixed. Therefore, each time when the cover is opened, the fixing of the position of the process unit is released. In particular, the cover of the device main body is opened and closed not only when replacing a specific process unit but also when removing jammed paper or removing another process unit. If the fixing of the position of the process unit is released each time when the cover is opened, a mechanism for fixing the position of the process unit deteriorates unnecessarily.

SUMMARY OF THE INVENTION

According to the present invention, since a cover of a device main body is not provided as a part of a mechanism for fixing a position of a process unit, the fixing of the position of the process unit is not released each time when the cover is opened.

According to an aspect of the present invention, in an image forming device, a process unit having devices related to an electrophotographic process is inserted into or removed from a device main body. The process unit is inserted into the device main body and fixed in the device main body by a lock mechanism. The lock mechanism includes a slide member, an urging member and a receiving part. The slide member is provided on the process unit and is movable in a perpendicular direction with respect to an inserting direction of the process unit. The urging member is provided between the slide member and the process unit. The urging member urges the slide member outward with respect to the process unit in the perpendicular direction. The receiving part is provided at a position in the device main body displaced from a passage where the process unit passes when being inserted into or removed from the device main body.

According to another aspect of the present invention, the slide member is supported rotatably on a main body of the process unit.

According to another aspect of the present invention, a gripper protruding towards an exterior of the device main body is provided on the main body of the process unit. The slide member is provided on the gripper.

According to the above-described aspects of the present invention, the position of the process unit with respect to the device main body can be fixed or the fixing of the position of the process unit with respect to the device main body can be released in units of a process unit. Therefore, the fixing of the position of the process unit is not released each time when the cover covering the device main body is opened. The slide member is provided as an operation unit for fixing the position of the process unit and releasing the fixing of the process unit. Therefore, the user can easily carry out an inserting operation or a removing operation of the process unit.

DETAILED DESCRIPTION OF THE INVENTION

An embodiment of the present invention will be described. Further, an embodiment to be described below is a preferable specific example for implementing the present invention. Therefore, there are various technical limitations in the description. However, unless explicitly stated in the following description to limit the present invention, the present invention shall not be limited to the embodiment.

A printer 1 as an image forming device according to an embodiment of the present invention will be described with reference to the drawings.

Figure 1:
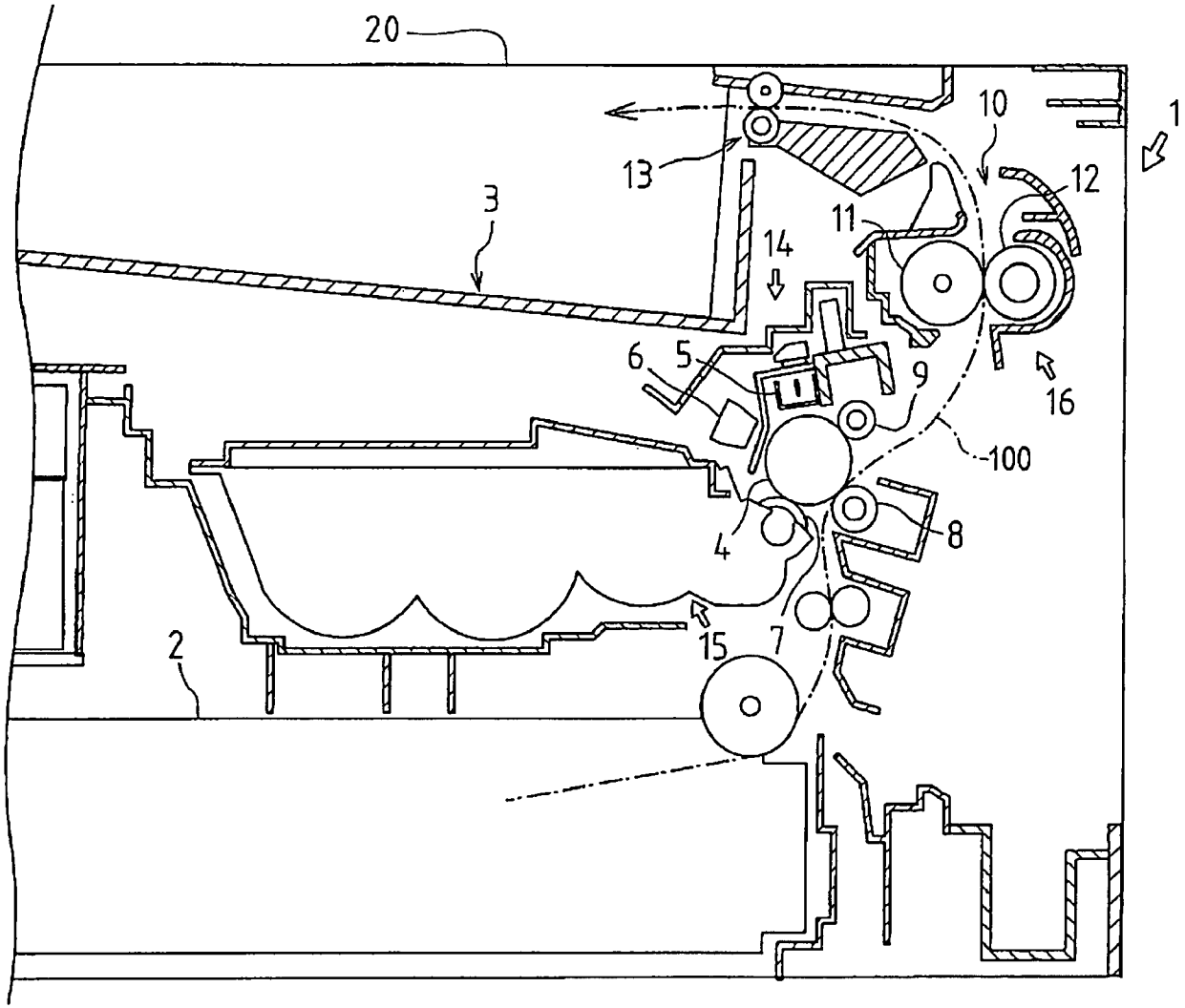
FIG. 1 is a schematic front view showing a configuration of each process device provided in a printer according to an embodiment of the present invention.

As shown in FIG. 1, the printer 1 is a device for forming a toner image on paper by an electrophotographic process. In the printer 1, a charging device 5, an exposing device 6, a developing device 7, a transferring device 8, a cleaning device 9 and a fixing device 10 are provided. These devices 5 through 10 are provided along a printing paper transportation path 100 leading from a paper feed device 2 to a paper discharge tray 3. Further, the paper feed device 2 accommodates printing papers.

In the printing paper transportation path 100, a photoconductive drum 4 is disposed downstream of the paper feed device 2. An electrostatic latent image is formed on the photoconductive drum 4. The charging device 5, the exposing device 6, the developing device 7, the transferring device 8 and the cleaning device 9 are provided around the photoconductive drum 4. The charging device 5 uniformly charges a surface of the photoconductive drum 4. A Light Emitting Diode (LED) head as the exposing device 6 irradiates light onto the uniformly charged photoconductive drum 4. Accordingly, the electrostatic latent image is formed on the surface of the photoconductive drum 4. A toner is supplied from a developing roller as the developing device 7 onto the photoconductive drum 4 on which the electrostatic latent image is formed. Accordingly, a toner image is formed on the photoconductive drum 4. The toner image on the photoconductive drum 4 is transferred onto paper by a transfer roller as the transferring device 8. The toner remaining on the photoconductive drum 4 after a transfer process is collected by an eraser brush as the cleaning device 9.

In the printing paper transportation path 100, the fixing device 10 is disposed downstream of the photoconductive drum 4. The fixing device 10 adopts a heat roller fixing method. The fixing device 10 includes a heat roller 11 and a press roller 12. The heat roller 11 heats the paper on which the toner image is transferred. The press roller 12 presses this paper. Accordingly, the toner image is fixed onto the paper. Furthermore, in the printing paper transportation path 100, a discharge roller device 13 is disposed downstream of the fixing device 10. The discharge roller device 13 discharges onto the paper discharge tray 3, the paper that passed through the fixing device 10.

Many of the above-described devices relating to an electrophotographic process are unitized as a single unit or a plurality of collective units. As such a process unit, there are a drum unit 14, a toner unit 15 and a fixing unit 16. In the drum unit 14, the photoconductive drum 4, the charging device 5 and the eraser brush are collected and unitized. In the toner unit 15, a toner container and the developing roller are collected and unitized. In the fixing unit 16, the fixing device 10, in other words, the heat roller 11 and the press roller 12, are unitized.

Each process unit can be inserted into and removed from a device main body 20 of the printer 1. The inserted process unit is fixed in the device main body 20 by a lock mechanism. In case each device relating to the electrophotographic process is consumed and required to be replaced, each process unit is replaced. Further, in the present embodiment, the transfer roller 8 is not unitized and is supported directly by the device main body 20 of the printer 1.

Figure 2:
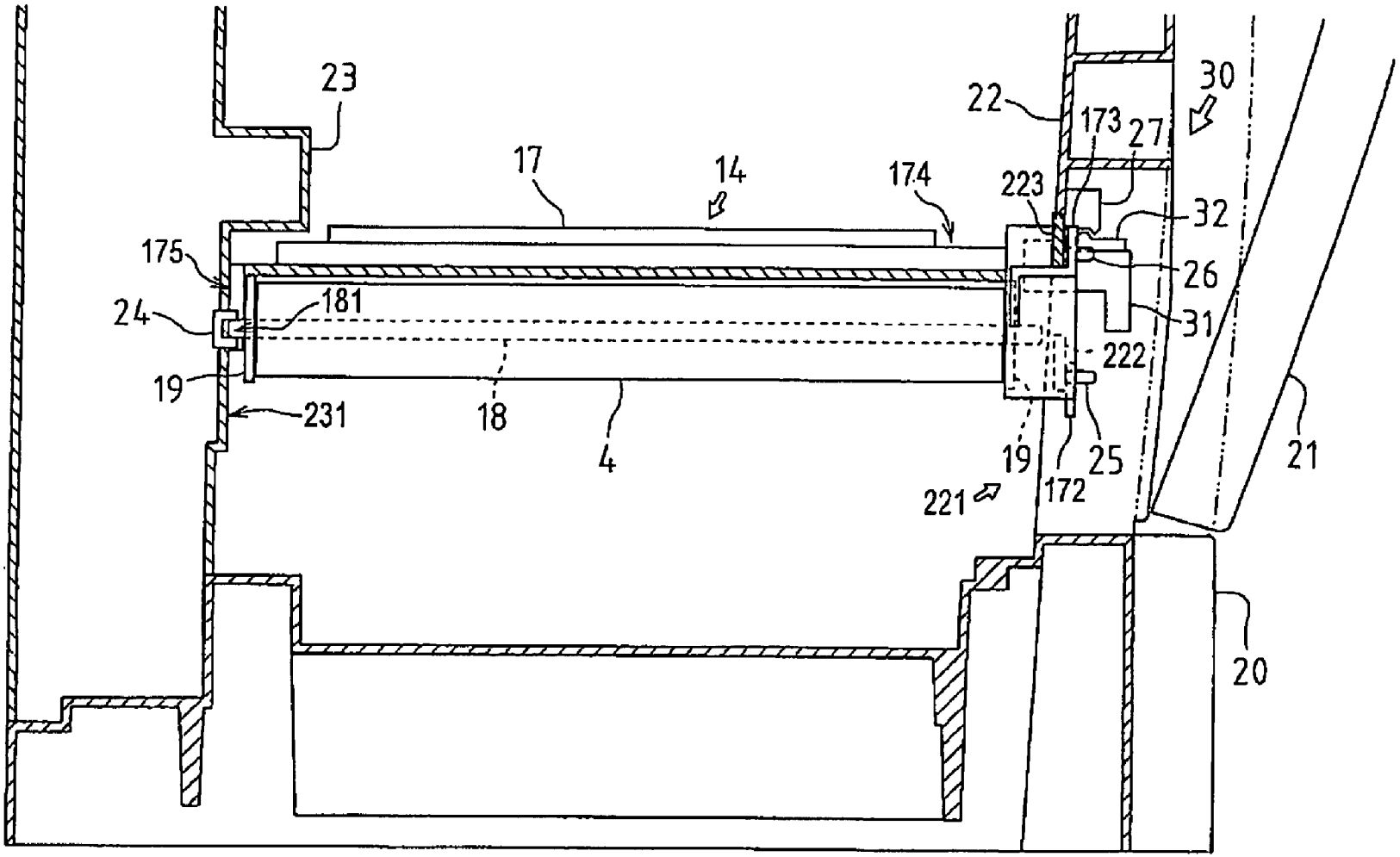
FIG. 2 is a cross-sectional side view of a printer having a drum unit and a device main body according to an embodiment of the present invention.

As shown in FIG. 2, a front cover 21 is provided in a manner capable of being opened and closed with respect to the device main body 20. The front cover 21 is located at a front surface side of the device main body 20, in other words, at a side where a user performs an operation. Although not shown in FIG. 1 and FIG. 3, the front cover 21 is located at a front side in the page of FIG. 1 and FIG. 3. Specifically, the front cover 21 is opened and closed by a lower end part of the front cover 21 swinging around a shaft that is parallel to a width direction of the device main body 20 (a left-right direction in FIG. 1 and FIG. 3).

In the device main body 20, a front frame 22 is a frame located at the front side more than a position where each process device of the photoconductive drum 4 is disposed. A rear frame 23 is a frame located at the rear side more than the position where each process device of the photoconductive drum 4 is disposed. Further, in the rear frame 23, a drive mechanism for driving a roller of each process device is provided.

Figure 3:
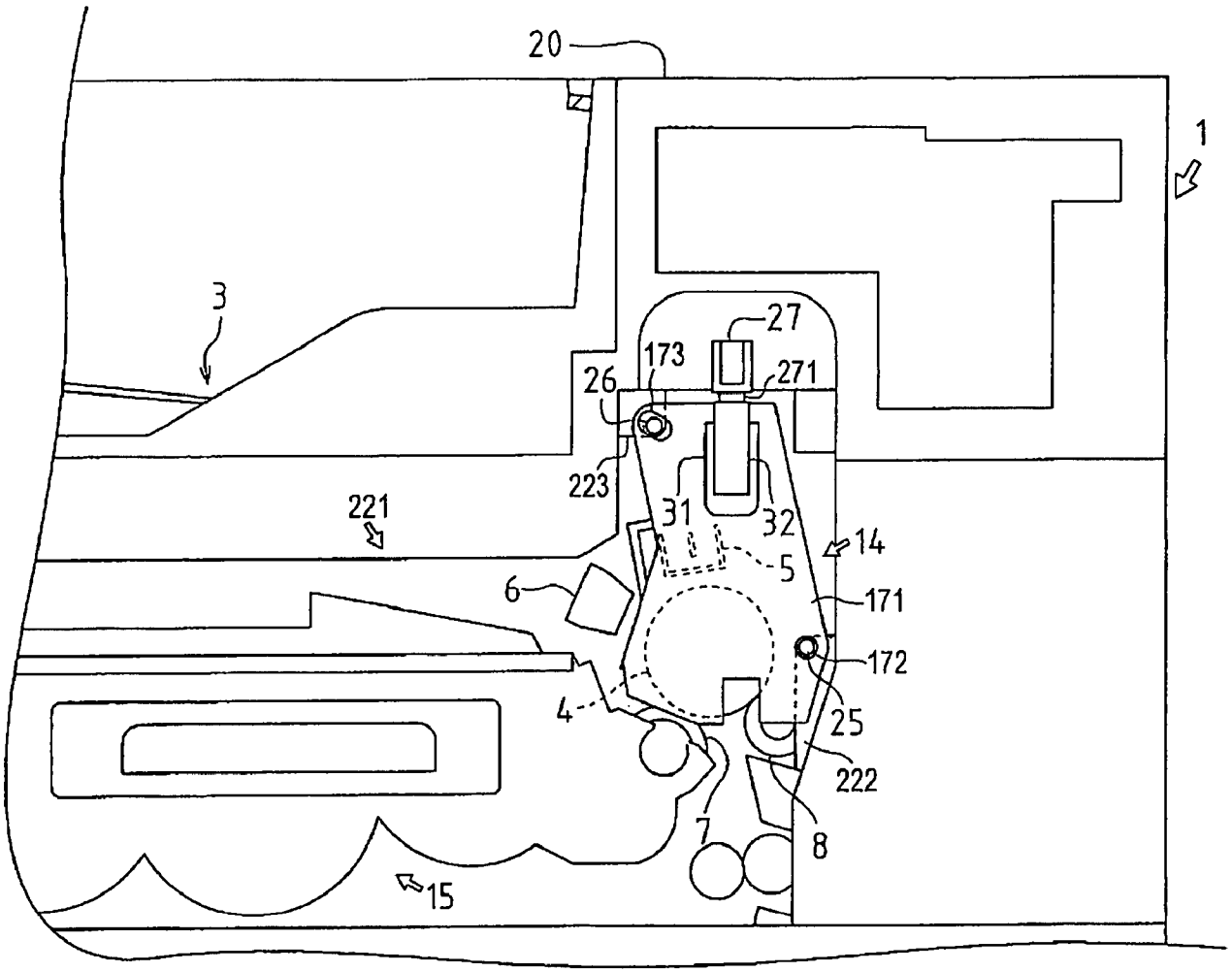
FIG. 3 is a front view of an image forming device under a state in which a front cover is opened according to an embodiment of the present invention.

As shown in FIG. 2 and FIG. 3, an opening 221 is formed through the front frame 22 for inserting and removing the drum unit 14 and the toner unit 15. Therefore, when the front cover 21 is opened, among the process units, the drum unit 14 and the toner unit 15 are exposed to the exterior of the device main body 20. Thus, under a state in which the front cover 21 is opened, the user can insert and remove the drum unit 14 and the toner unit 15 through the opening 221.

Figure 4:
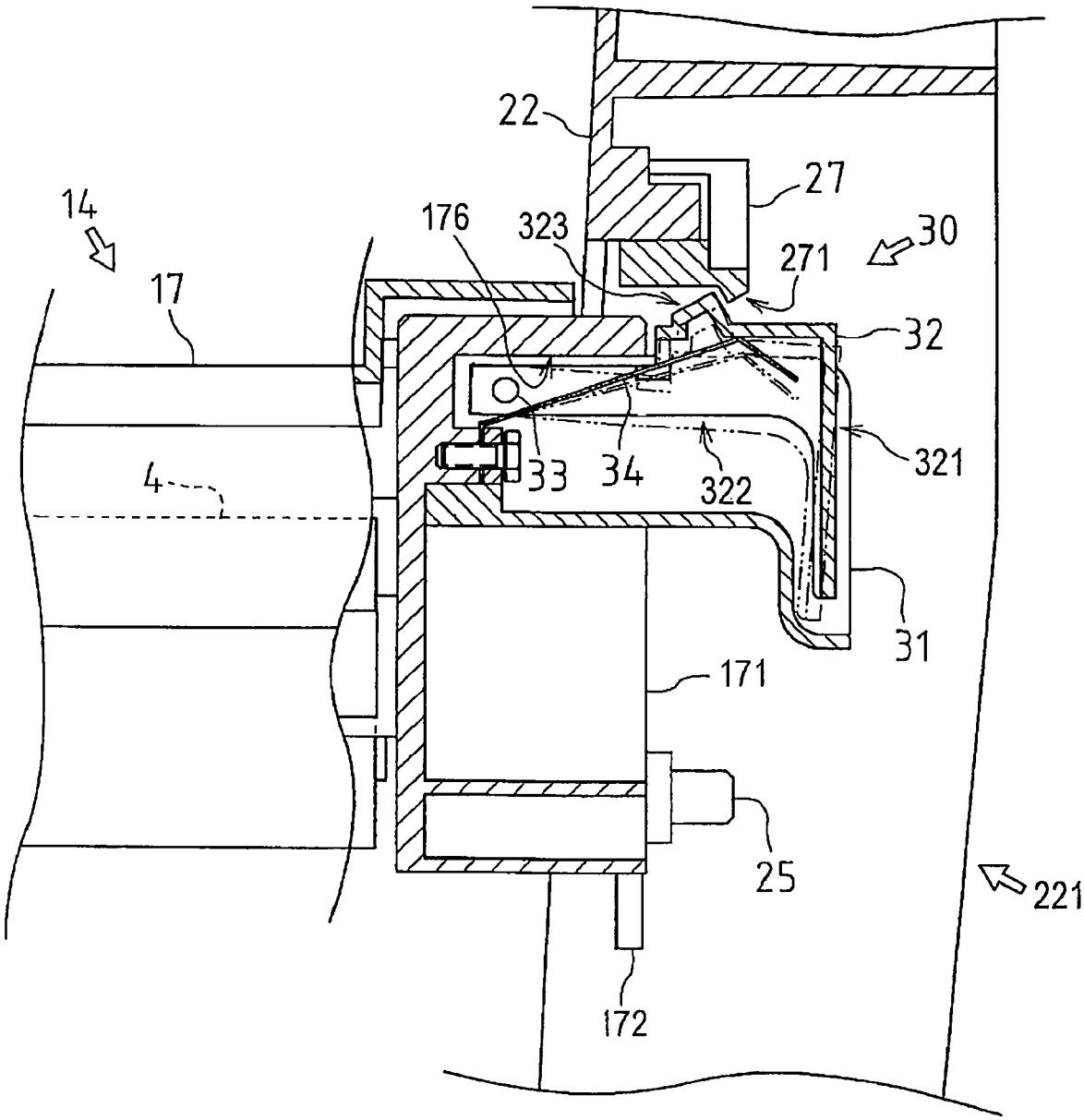
FIG. 4 is a side view showing a lock mechanism according to an embodiment of the present invention.

With reference to FIG. 2 through FIG. 4, a description will be made of a structure for fixing a position of the drum unit 14 with respect to the device main body 20. The drum unit 14, which is one of the process units, can be inserted into and removed from the device main body 20 in a front-back direction of the printer 1. Under a state in which the drum unit 14 is inserted in the printer 1, the drum unit 14 is fixed in the device main body 20 by a lock mechanism 30. The position of the inserted drum unit 14 is fixed in the device main body 20 in the inserting and removing direction of the drum unit 14 (in the front-back direction). The position of the inserted drum unit 14 is fixed in the device main body 20 also in a perpendicular direction with respect to the inserting and removing direction. The position of the drum unit 14 in the inserting and removing direction is fixed by fixing the drum unit 14 with respect to the device main body 20 by the lock mechanism 30. The position of the drum unit 14 in the perpendicular direction is fixed by engaging an engaging part of each of the drum unit 14 and the device main body 20 with one another.

Next, the drum unit 14 will be described. The drum unit 14 includes the photoconductive drum 4, the charging device 5, a drum casing 17 and a part of the lock mechanism 30. The drum casing 17 supports the photoconductive drum 4 and the charging device 5. Although details will be described later, the lock mechanism 30 includes members provided in the drum unit 14 and members provided in the device main body 20. The photoconductive drum 4 is a cylindrical body. A metal shaft 18 is inserted through an axial center position of the photoconductive drum 4 and protrudes outward from both end parts in an axial direction of the photoconductive drum 4. The photoconductive drum 4 is fixed on the shaft 18. The shaft 18 is supported rotatably by bearings 19 at both end parts in the axial direction of the photoconductive drum 4. The bearings 19 are fixed on the drum casing 17. The photoconductive drum 4 is supported rotatably by the drum casing 17 as described above.

An extending direction of the shaft 18 corresponds with the inserting and removing direction of the drum unit 14 with respect to the device main body 20. Therefore, in the following, the inserting and removing direction of the drum unit 14 with respect to the device main body 20 may be referred when defining the direction of the drum unit 14.

With reference to FIG. 2 and FIG. 3, a description will be made of a fixing of a position of the drum unit 14 in the perpendicular direction with respect to the device main body 20. The fixing of the position is carried out with respect to the device main body 20 at both end parts in the inserting and removing direction of the drum unit 14. An engaging part is provided respectively at both end parts of the drum unit 14 and corresponding parts of the device main body 20 to be engaged with one another. By the engagements of the engaging parts, the position of the drum unit 14 is fixed with respect to the device main body 20 at both end parts in the inserting and removing direction.

The engaging part at an end part in the inserting direction is configured with a tip end part 181 of the shaft 18 in the inserting direction and a bearing 24 fixed on the rear frame 23. Specifically, in the drum unit 14, the tip end part 181 of the shaft 18 in the inserting direction protrudes outward more than an outer end surface of the bearing 19 fixed on the drum casing 17. Meanwhile, when the drum unit 14 is inserted into the device main body 20, the bearing 24 is fixed on the rear frame 23 at a position where the tip end part 181 of the shaft 18 is inserted. Further, in the device main body 20, a guide member (not shown) is provided for guiding a movement of the drum unit 14 in the inserting and removing direction. By the engagement of the tip end part 181 and the bearing 24, the rotation of the photoconductive drum 4 around the shaft 18 is permitted. However, the photoconductive drum 4 is prohibited from moving in a direction perpendicular to the inserting and removing direction.

The engaging parts at the end part in the inserting and removing direction are configured with a first engaging pin 25 and a second engaging pin 26 protruding from the front surface side of the front frame 22 and a first engaging hole 172 and a second engaging hole 173 formed on a flange 171 of the drum casing 17.

The drum casing 17 has the flange 171 at an end part in the removing direction. The flange 171 is wide in a direction perpendicular to the inserting and removing direction. Meanwhile, the first engaging pin 25 is protruding in the removing direction from a first supporting part 222 of the front frame 22. The second engaging pin 26 is protruding in the removing direction from a second supporting part 223 of the front frame 22. An opening of the hole 221 is narrowed by the first supporting part 222 and the second supporting part 223. Only a main body part 174 of the drum casing 17 excluding the flange 171 can be inserted in the narrowed opening. Therefore, under a state in which the drum unit 14 is inserted, the flange 171 and the first supporting part 222 and the second supporting part 223 overlap with one another.

Under the state in which the drum unit 14 is inserted in the device main body 20, the first engaging pin 25 is inserted into the first engaging hole 172 and the first engaging pin 25 and the first engaging hole 172 are engaged with one another, and the second engaging pin 26 is inserted into the second engaging hole 173 and the second engaging pin 26 and the second engaging hole 173 are engaged with one another. Accordingly, the drum unit 14 is fixed on the front frame 22 at two positions on a vertical surface of the drum unit 14 with respect to the inserting direction. The drum unit 14 is prohibited from moving towards a direction perpendicular to the inserting direction with respect to the front frame 22 and is prohibited from rotating around the shaft 18.

Among the engaging holes 172 and 173, the second engaging hole 173 is a long hole. Accordingly, an engaging position of the second engaging pin 25 in the second engaging hole 173 can be varied to absorb a fluctuation in a clearance between the device main body 20 and the drum unit 14, which is a replacement.

In the manner described above, the position of the drum unit 14 is fixed in a direction perpendicular to the inserting and removing direction with respect to the front frame 22 and the rear frame 23. Accordingly, the position of the drum unit 14 is fixed in the perpendicular direction with respect to the device main body 20.

Next, with reference to FIG. 2 through FIG. 4, a description will be made of a method for fixing a position of the drum unit 14 with respect to the device main body 20 in the inserting and removing direction. The drum unit 14 is inserted into the device main body 20 and pushed against the rear frame 23. Under this state, the position of the drum unit 14 is fixed by the lock mechanism 30 and the drum unit 14 is prevented from moving in the inserting and removing direction.

As shown in FIG. 2, when the drum unit 14 is inserted in the device main body 20, a rear end surface 175 of the drum casing 17 is pushed against a front surface 231 of the rear frame 23. In the axial direction of the photoconductive drum 4, the rear end surface 175 is located at an opposite side from the flange 171. When the drum unit 14 is pushed against the rear frame 23, the tip end part 181 of the shaft 18 is inserted into the bearing 24.

With reference to FIG. 3 and FIG. 4, the lock mechanism 30 will be described. The lock mechanism 30 includes members provided in the drum unit 14 and members provided in the device main body 20. The lock mechanism 30 can fix the position of the drum unit 14 with respect to the device main body 20 and release the fixing of the position of the drum unit 14 with respect to the device main body 20.

First, among a plurality of members of the lock mechanism 30, a description will be made of members provided in the drum unit 14. A gripper 31 is provided protruding towards the removing direction from the flange 171 of the drum casing 17. A lock lever 32 as a slide member is provided on the gripper 31 in a manner that a tip end side of the lock lever 32 in the inserting direction is rotatable around a shaft 33. The lock lever 32 is formed in a letter L-shape when viewed sideways (in a direction perpendicular to the page of FIG. 2 and FIG. 4). A base part 321 of the L-shape is located at an end part in the removing direction. A rising part 322 of the L-shape extends in the removing direction. An engaging claw 323 protrudes from an upper surface of the rising part 322. Further, the engaging claw 323 engages with a receiving claw 271 to be described later.

A leaf spring 34 as an urging member is provided between the gripper 31 and the lock lever 32. The lock lever 32, which rotates around the shaft 33, is urged by the leaf spring 34 so that a rear end part of the lock lever 32 (a tip end part in the removing direction) faces upward. An upward movable range of the lock lever 32 is restricted by a restraining part 176 formed on an upper end part of the flange 171. Specifically, the rising part 322 of the lock lever 32 makes contact with the restraining part 176 to restrain the upward movement of the lock lever 32. Under a state in which an external force other than an external force of the leaf spring 34 is not acting upon the lock lever 32 (under a state in which the user is not touching the lock lever 32), the lock lever 32 makes contact with the restraining part 176. The position of the lock lever 32 under this state is a lock position.

Next, among the plurality of members of the lock mechanism 30, a description will be made of the member provided in the device main body 20. A lever receiver 27, which is a receiving part, is fixed on the front frame 22 at an upper position of the hole 221. The receiving claw 271 protruding downward is formed on the lever receiver 27. The lever receiver 27 having the receiving claw 271 is located at a position displaced from a passage where the drum unit 14 passes when being inserted or removed. Therefore, the lever receiver 27 does not interfere with the inserting and the removing of the drum unit 14.

As shown in FIG. 3, under a state in which the drum unit 14 is inserted in the device main body 20, the gripper 31 and the lever receiver 27 are located one above the other. The layout of the gripper 31 and the lever receiver 27 is designed so that the engaging claw 323 formed on the upper surface of the lock lever 32 located at the lock position and the receiving claw 271 protruding downward from the lever receiver 27 engage with one another.

As shown in FIG. 4, when the lock lever 32 is located at the lock position, the receiving claw 271 makes contact with the engaging claw 323 in the inserting direction. Therefore, the drum unit 14 is restrained from moving toward the removing direction with respect to the device main body 20. In this case, the drum unit 14 is provided fixed with respect to the device main body 20. When the user presses the base part 321 of the lock lever 32 and moves the lock lever 32 downward against the urging force of the leaf spring 34, the engaging claw 323 and the receiving claw 271 are disengaged and the drum unit 14 becomes movable in the inserting and removing direction with respect to the device main body 20.

In other words, when the lock lever 32 is located lower than the lock position, the fixing of the position of the drum unit 14 in the inserting and removing direction with respect to the device main body 20 is released. Under a state in which the drum unit 14 is inserted in the device main body 20 and pushed against the rear frame 23, unless an external force is applied (when the pressing of the base part 321 is released by a finger), the lock lever 32 returns to the lock position and the position of the drum unit 14 is fixed with respect to the device main body 20.

Further, when inserting the drum unit 14 into the device main body 20, without operating the lock lever 32, just by pushing the drum unit 14 towards the rear frame 23, the drum unit 14 is fixed and set in the device main body 20. This is due to the fact that an end surface of the engaging claw 323 in the inserting direction and an end surface of the receiving claw 271 in the removing direction are both slanted in a manner that a front side is located higher and a rear side is located lower (in FIG. 4, the right side of the end surfaces are located higher). When the drum unit 14 is inserted into the device main body 20, the end surface of the engaging claw 323 in the inserting direction and the end surface of the receiving claw 271 in the removing direction make contact with one another vertically (in a direction perpendicular to the inserting and removing direction). As described above, since the end surfaces are slanted in a manner that the right side is located higher as shown in FIG. 4, when the drum unit 14 is inserted further against the urging force of the leaf spring 34, the lock lever 32 is pushed downward and the inserting movement of the drum unit 14 is not restrained. Then, under a state in which the drum unit 14 is making contact with the rear frame 23, the contact of the engaging claw 323 and the receiving claw 271 in the vertical direction (in the direction perpendicular to the inserting and removing direction) is released. Accordingly, the lock lever 32 automatically returns to the lock position and the position of the drum unit 14 is fixed with respect to the device main body 20.

A contact surface of the receiving claw 271 with respect to the engaging claw 323 (the end surface in the inserting direction) is formed slanting so that the front side is located lower and the rear side is located higher, in other words, the right side is located lower in FIG. 4. Therefore, when swinging the lock lever 32, which moves along a circular orbit around the shaft 33, downward, the receiving claw 271 does not interfere with the swing of the lock lever 32. A contact surface of the engaging claw 323 with respect to the receiving claw 271 (the end surface in the removing direction) is formed slanting so that the front side is located lower and the rear side is located higher, in other words, the right side is located lower in FIG. 4. Therefore, when the lock lever 32 is located at the lock position, the engaging claw 323 and the receiving claw 271 make surface contact and not line contact with one another. Therefore, the drum unit 14 is fixed firmly with respect to the device main body 20.

As described above, since the position of the drum unit 14 is fixed with respect to the device main body 20, a cover that covers the device main body 20, specifically, the front cover 21, is not involved at all. Therefore, the fixing of the position of the drum unit 14 is not released each time when the front cover 21 is opened.

In the lock mechanism 30, with the shaft 33 as the swing center, a power point (the base part 321) and an acting point (the engaging claw 323) are located at an end part of the lock lever 32. Therefore, even in case the lock lever 32 as the slide member is used as an operation unit for fixing the position of the drum unit 14, which is a process unit, and releasing the fixing of the position of the drum unit 14, an operation load placed on the user is small.

The lock lever 32, which is an operation unit for fixing the position of the drum unit 14, which is a process unit, and releasing the fixing of the position of the drum unit 14, is located at a position protruding towards the removing direction more than the drum casing 17, which is the main body of the drum unit 14. Thus, there is an improvement in operationality of the user when fixing the position of the drum unit 14 and releasing the fixing of the position of the drum unit 14.

The invention claimed is:

1. An image forming device, comprising:

a device main body;

a process unit including a photoconductive drum which is inserted into and removed from the device main body; and a lock mechanism which fixes a position of the process unit inserted in the device main body;

wherein the lock mechanism comprises:

a slide member which is provided on the process unit and is movable in a perpendicular direction with respect to an inserting and removing direction of the process unit;

an urging member which is provided between the process unit and the slide member and urges the slide member outward in the perpendicular direction; and a receiving part which is provided at a position in the device main body displaced from a passage where the process unit passes when being inserted and removed, and makes contact with the slide member urged outward in an inserting direction.

2. The image forming device according to claim 1, wherein the process unit is inserted and removed in a front-back direction with respect to the device main body.

3. The image forming device according to claim 2, wherein the process unit includes a casing and a gripper protruding from the casing towards a removing side, and the slide member is provided on the gripper.

4. The image forming device according to claim 3, wherein the slide member is supported rotatably on the gripper.

5. The image forming device according to claim 4, wherein the urging member urges the slide member upward, and an engaging claw protruding upward from the slide member and a receiving claw protruding downward from the receiving part engage with one another to fix a position of the process unit at a lock position in the device main body.

6. The image forming device according to claim 5, wherein an end surface of the engaging claw in the inserting direction and an end surface of the receiving claw in the removing direction are both slanted in a manner that a removing side is located higher and an inserting side is located lower.

7. The image forming device according to claim 5, wherein when the slide member is located at the lock position, the engaging claw and the receiving claw make a surface contact.

8. The image forming device according to claim 7, wherein a contact surface of the engaging claw with respect to the receiving claw is slanted in a manner that the removing side is located lower and the inserting side is located higher.

9. The image forming device according to claim 2, wherein the device main body includes a front frame on which a hole is formed and a front cover which is located at a front surface side of the device main body, and under a state in which the front cover is opened, the process unit is inserted and removed through the hole.

10. The image forming device according to claim 2, wherein a position of the process unit is fixed in the perpendicular direction at both end parts in the inserting and removing direction.

11. A process unit, which is inserted into and removed from a device main body, comprising:

a photoconductive drum; and a part of a lock mechanism that fixes a position of the process unit when the process unit is inserted in a device main body, wherein the part of the lock mechanism comprises:

a slide member which is provided on the process unit and is movable in a perpendicular direction with respect to an inserting and removing direction of the process unit; and an urging member which is provided between the process unit and the slide member and urges the slide member outward in the perpendicular direction.

12. The process unit according to claim 11, wherein the process unit is inserted and removed in a front-back direction with respect to the device main body.

13. The process unit according to claim 12, further comprising:

a casing; and a gripper which protrudes from the casing towards a removing side;

wherein the slide member is provided on the gripper.

14. The process unit according to claim 13, wherein the slide member is supported rotatably on the gripper.

15. The process unit according to claim 14, wherein the urging member urges the slide member upward and further includes an engaging claw which protrudes upward from the slide member.

16. The process unit according to claim 15, wherein an end surface of the engaging claw in an inserting direction is slanted in a manner that a removing side is located higher and an inserting side is located lower.

17. The process unit according to claim 15, wherein a contact surface of the engaging claw is slanted in a manner that the removing side is located lower and the inserting side is located higher.

18. The process unit according to claim 12, wherein a position of the process unit is fixed in the device main body in the perpendicular direction at both end parts in the inserting and removing direction.

19. A device main body in which a process unit is inserted comprising:

a part of a lock mechanism that fixes a position of the inserted process unit, wherein the part of the lock mechanism includes a receiving part which is provided at a position displaced from a passage where the process unit passes when being inserted and removed; and a receiving claw that protrudes downward from the receiving part.

20. The device main body according to claim 19, wherein an end part of the receiving claw in a removing direction is slanted in a manner that a removing side is located higher and an inserting side is located lower.

21. The device main body according to claim 19, further comprising:

a front frame on which a hole is formed; and a front cover which is located at a front surface side of the front frame.

* * * * *